US007083483B2

(12) United States Patent
Corlett

(10) Patent No.: US 7,083,483 B2
(45) Date of Patent: Aug. 1, 2006

(54) INFLATABLE SAILBOAT RACING MARK THAT CAN BE REDUCED IN SIZE FOR STORAGE WHILE INFLATED

(76) Inventor: Edwin H. Corlett, 111 Lawndale Ave., Elmhurst, IL (US) 60126

( * ) Notice: Subject to any disclaimer, the term of this patent is extended or adjusted under 35 U.S.C. 154(b) by 0 days.

(21) Appl. No.: 10/991,856

(22) Filed: Nov. 19, 2004

(65) Prior Publication Data

US 2006/0110991 A1 May 25, 2006

(51) Int. Cl.
*B63B 22/16* (2006.01)
*B63B 22/22* (2006.01)

(52) U.S. Cl. ..... 441/6; 441/30

(58) Field of Classification Search ..... 441/1, 441/6, 7, 13, 20, 21, 30
See application file for complete search history.

(56) References Cited

U.S. PATENT DOCUMENTS 3,280,549 A * 10/1966 Hsu ..... 60/721
3,877,096 A * 4/1975 Scesney ..... 441/6
5,179,907 A * 1/1993 Galbraith ..... 116/209

* cited by examiner

*Primary Examiner*—Jesus D. Sotelo

(57) ABSTRACT

A mark for sailboat racing having three inflatable elongated tubes joined closely at one common end so that when inflated, a mutual repelling force is developed at the common end causing the outboard ends of the elongated tubes to move away from each other. Lines join the outboard ends of the tubes so that their movement is limited to forming a tetrahedron. The outboard ends of the elongated tubes can be pushed together and constrained for transportation and storage.

2 Claims, 1 Drawing Sheet

INFLATABLE SAILBOAT RACING MARK THAT CAN BE REDUCED IN SIZE FOR STORAGE WHILE INFLATED

BACKGROUND OF THE INVENTION

1. Field of the Invention

The invention relates to an inflatable sailing mark for use in sailboat racing. In particular, this mark can be significantly reduced in size for transportation or storage without being deflated and then can be returned to its original size when desired.

2. Description of the Prior Art

Sailors have tested their sailing skills amongst each other since the beginning of sailboats by racing on a course defined by marks. The marks used vary to the extreme from land marks to present day large inflatable plastic floats. Present day large inflatable plastic floats are desirable because they are visible from a distance, light weight and ride high in the water. The main disadvantage is that they are difficult to transport and store when inflated because of their size. The obvious solution is to inflate them just before deployment and deflate after retrieval but this is very time consuming and inflation requires special equipment because of the volume of air needed.

SUMMARY OF THE INVENTION

The inflatable sailing mark of the present invention addresses the problem mentioned in prior art by providing both a savings on space and manpower. When desired, the mark can be easily compressed to a smaller size for storage by pushing its legs together and constraining them. To redeploy it, the constraint is removed and the mark assumes its original shape.

DESCRIPTION OF THE PREFERRED EMBODIMENTS

Figure 1:
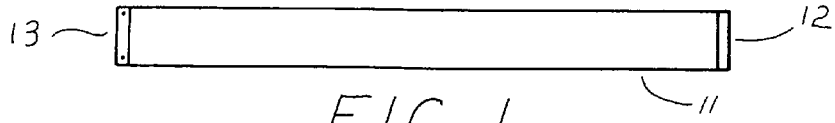
FIG. 1 is a front elevation view of a deflated buoyant member disposed horizontally.
Figure 2:
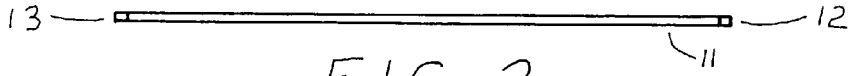
FIG. 2 is a side view of FIG. 1 showing that the deflated buoyant member lays flat.

Referring now to the drawings, it is seen that the sailboat racing mark, generally denoted by reference numeral 10, is comprised of three inflatable buoyant members 11. Each buoyant member 11 has one end 12 reinforced for closely joining to the other buoyant members with the opposite end 13 reinforced with attachment holes for attaching a restraining device 14.

Figure 3:
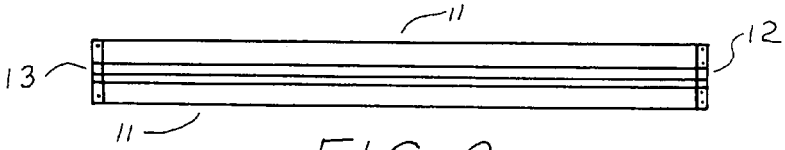
FIG. 3 is a front elevation view of three deflated buoyant members disposed horizontally and closely joined at a common end.
Figure 4:
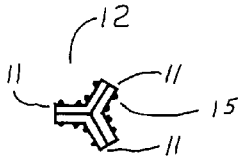
FIG. 4 is an end view of FIG. 3 showing the end of the deflated mark where the three buoyant members are closely joined.

FIGS. 3 and 4 depict three deflated buoyant members 11 closely joined at a common end 12. FIG. 4 in particular shows how one half of each buoyant member 11 is closely joined to one half of another buoyant member 11 until all halves of each individual buoyant member are closely joined. Rivets 15 are used for joining the halves together.

Figure 5:
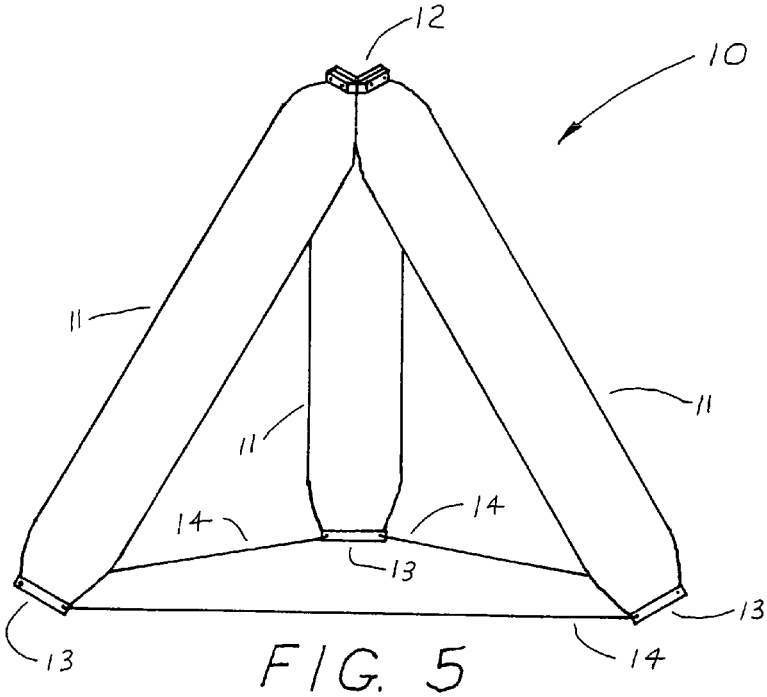
FIG. 5 is a front perspective view disposed vertically of the sailing mark with its three buoyant members inflated and restrained so as to assume the shape of a mark suitable for a sailboat race.

FIG. 5 depicts the sailboat racing mark 10 in its deployed form. The three buoyant members 11 have been inflated causing a mutual repelling force at their closely joined ends 12 causing their outboard ends 13 to move commonly away from each other until a restraining device 14, in this case a line, stops them causing the mark 10 to take the form of a tetrahedron. The outboard ends 13 of the buoyant members 11 can be gathered together so that the buoyant members 11 lay parallel to each other thereby making the mark 10 more compact and easier to store.

Although only one preferred embodiment of this invention has been disclosed, it will be understood that various changes and modifications may be made without departing from the spirit and scope of this invention as defined in the appended claims.

I claim:

1. A sailboat racing mark which comprises a multitude of connected buoyant members consisting of elongated flexible tubes, sealed at both ends so as to be air tight and buoyant, closely joined at a common end so that when inflated adjacent buoyant members experience a mutual repelling force and a restraining device comprising individual lines connected between the outboard ends of said adjacent buoyant members that controls the position of said buoyant members so that said buoyant members assume a shape that is to be used as a mark for sailboat racing but can be reduced in size for storage without affecting its buoyancy.

2. A sailboat racing mark as recited in claim 1 which comprises three said buoyant members with said lines of such length that said buoyant members with said lines assume the shape of a tetrahedron and where said mutual repelling force can be overcome manually by forcing the three outboard ends of said buoyant members closely together so that said buoyant members become parallel and said mark reduces in size to facilitate storage.

* * * * *